United States Patent [19]

Hughes et al.

[11] 4,018,673

[45] Apr. 19, 1977

[54] CENTRIFUGE PROCESSING OF HIGH-SOLIDS CLAY

[75] Inventors: Randall E. Hughes, Sandersville; Edward P. Jordan, Thomson, both of Ga.

[73] Assignee: Thiele Kaolin Company, Sandersville, Ga.

[22] Filed: Feb. 27, 1976

[21] Appl. No.: 662,135

[52] U.S. Cl. ..... 209/5; 106/288 B; 106/72; 241/4; 241/16; 241/20; 209/211

[51] Int. Cl.[2] ..... B03B 1/04

[58] Field of Search ..... 106/288 B, 72; 241/4, 241/16, 20; 209/5

[56] References Cited

UNITED STATES PATENTS

| | | | |
|---|---|---|---|
| 3,371,988 | 3/1968 | Maynard | 106/72 |
| 3,464,634 | 9/1969 | Brociner | 106/72 |
| 3,536,264 | 10/1970 | Helton et al. | 106/72 |
| 3,539,003 | 11/1970 | Bidwell | 209/5 |
| 3,572,500 | 3/1971 | Kouloheris | 209/5 |

*Primary Examiner*—Winston A. Douglas
*Assistant Examiner*—J.V. Howard
*Attorney, Agent, or Firm*—Merriam, Marshall, Shapiro & Klose

[57] ABSTRACT

Method of removing coarse materials and chemical and mineral impurities from clay in order to produce a purified high solids suspension of said clay which method involves mixing a crude clay with water and a dispersing agent to form a high solids slurry; subjecting said slurry to intense centrifugal forces for a short period of time; separating said coarse material and said chemical and mineral impurities; and recovering the suspended clay as a fine fraction having a reduced content of coarse material and impurities.

15 Claims, No Drawings

CENTRIFUGE PROCESSING OF HIGH-SOLIDS CLAY

The present invention is directed to a process for preparing an aqueous, high-solids clay dispersion, wherein the clay is substantially free of coarse materials, i.e., materials having average particle sizes greater than 44 microns, and wherein the clay has a reduced content of impurities such as quartz, zircon, iron, and titanium, as well as improved brightness.

In recent years the market for clay slurries has grown and today it is commonplace to mine, process and ship clay, at the time of shipping, in the form of a high solids aqueous dispersion. The typical aqueous clay dispersion product moving through commerce is from about 68 to 70% by weight solids.

When clay is mined it usually contains significant quantities of quartz, zirconium oxides, iron compounds, titanium oxides, mica and other impurities which must be removed from the clay before it can be commercially utilized. Additionally, the crude clay typically contains relatively large particles (i.e. particles having average diameter greater than 10 microns) of kaolinite-based materials which must be removed.

Conventional methods for removing the large sized particles (+10 $\mu$) from kaolin require the dilution of the clay to 40% or lower solids, at which concentration it can be conveniently sedimented by gravity or centrifuge to remove the coarse materials and some of the undesired impurities. While sedimentation process is capable of making a useful product, it is then necessary to dewater the clay to 70% solids, which requires additional processing which consumes additional energy.

Alternatively, screening systems have been used to remove the coarse kaolinitic particles, and those impurities which are relatively large in size. Typically, conventional screening processes use a 325 mesh screen which will screen out particles having an average diameter greater than 44 microns. Such screening processes do not, however, remove impurities which have relatively small particle sizes nor do they remove a significant amount of particles larger than 10 microns, which must be removed to meet many product specifications. Additionally, the screening process inherently produces problems with screen plugging which renders it a relatively inefficient process.

It is well known that clay at 70% solids will not settle significantly under static conditions. The usual explanation is that the viscosity associated with such slurries is so high that settling cannot occur and, in fact, under static conditions such clays tend to form gel structures between particles which inhibit settling. While this is advantageous with respect to shipping the product, the formation of gel structures inhibits the removal of any large particles or other impurities.

The present invention is based on the discovery that centrifuge processing of high solids slurries, e.g., 70% by weight solids, will remove the +325 mesh screen residue or coarse materials from the slurry, in the same manner as conventional screening process, but additionally the centrifuge will remove undesired impurities and particles larger than 10 microns. More particularly the centrifuging process will dramatically reduce the level of zirconium dioxide and quartz impurities, both of which are highly abrasive and undesirable in commercial clay slurries. In addition to the reduction of zircon and quartz impurities from the clay being processed, iron compound impurities, and titanium dioxide impurities are reduced and the brightness of the resulting clay is improved.

The present invention is adapted to produce a kaolin slurry at 70% solids which meets the present day specifications for a filler-type clay or a coating clay. The present method is particularly useful in removing many particles in the 10–44 micron range, a range of particles which are not removed by conventional screening processes. Further, the present invention may be used to remove a major portion of the 5–10 micron size particles. Additionally, the present invention removes from clay impurities such as quartz which would not be removed by screening. Thus the present invention can be used to render useful a clay with a substantial quartz content, which cannot be successfully removed by screening. Finally, the present invention produces large savings in energy and chemical input while greatly improving production efficiency and increasing the percent recovery from available kaolin resources.

While applicants do not wish to be bound by any theory, it is postulated that the process of the present invention is successful because the differential of the specific weights of the clay particles as compared to the impurity particles present in the crude clay slurry is more pronounced in the centrifuge, particularly in a high solids slurry. It is known that titanium dioxide and zirconium dioxide and the most abundant iron compounds have specific gravities which exceed 4, while kaolinitic materials have specific gravities in the range of 2.6, similar to mica and quartz. It has been found that the present invention can be used to remove zircon, titanium impurities and iron impurities which have particle sizes as small as 1 micron. The present invention will also remove quartz, mica, and kaolinitic particles in the 5–40 micron size range.

It is deemed important to operate at the process of the present invention at the highest possible solids level. Calculations have shown that titanium dioxide particles having an average size of 4 microns, which have an average density of 4.5, will settle from a slurry of 35% solids 2.2 times as fast as clay particles having similar size. When the solids level of the slurry is increased to 70% solids, the 4 micron titanium dioxide settles out 3.3 times as fast as the similar sized clay particles. Thus, the high solids slurry amplifies the density differences which exist between the impurities and the clay particles. Calculations also show that increasing the solids contents of the slurry from 35 to 70% will reduce the tendency of the 40 micron clay particles to settle, as compared to the tendency of a 4 micron clay particle. However, even at 70% solids level, the 40 micron particles tend to settle out of the slurry 100 times as fast as the 4 micron particles. A clay slurry at 70% solids has a specific gravity of from about 1.7 to 1.8. When such a slurry is held in a tank, viscosity of the slurry is sufficiently high that under static conditions essentially no sedimentation occurs despite the differences in weight of the component material. The differential specific weights are not enough to overcome the viscosity effect and both the coarse particles and the high density impurities are held in suspension. When such a slurry is subjected to centrifugation, the differences in specific weights are magnified, since all of the relative weight differences are increased by the centrifugal force on the slurry. Therefore the actual difference in the density between the high specific gravity impurities and the kaolinitic materials increases and the heavy impurities are preferentially sedimented.

The present invention is most effectively applied to selected clays. More particularly those clays which have a relatively small average particle size, i.e., at least 75% by weight of particles less than 2 microns, and are relatively free of coarser particles are most advantageously treated with the present invention. While coarser clays can be used, and those clays which contain more than about 25% by weight of particles larger than 2 microns can be treated by the present invention, in order to achieve the desired range of particle sizes as much as 25% by weight of the clay must be precipitated, which may be uneconomical with respect to recovery.

Maximum advantages of the present invention are attained by using clay slurries at the highest realistic clay solids. The highest useable solids level will vary from one clay to another, depending upon the rheology characteristics of the particular clay. The maximum useable solids level must be somewhat below the solids level at which the slurry will solidify, and must be a solids level at which a reasonable viscosity may be obtained. It has been found that if the viscosity of the clay slurry is too high, even though the slurry may be pumpable, that poor separation of the impurities is obtained when the clays are treated in conventional centrifuge-type equipment. While the present invention contemplates treating clay slurries having viscosities in excess of 2000 cps, such slurries require very high centrifugal forces in order to obtain reasonable separation of the impurities. Generally, it is felt that the clay slurry must have a viscosity no greater than about 2000 cps to obtain practical results using present day, commercially available centrifuges. It is preferred to have slurries which have viscosities less than 1000 for best results using conventional equipment.

It is generally preferred to adjust the solids high enough to give a viscosity such that the clay will not settle under static conditions. In those cases where the slurry is pumpable at solids in the range of 70–72% by weight, the centrifugal treatment at the 70–72% solids level will yield a product which is substantially free of coarse material, has a reduced level of impurities and which has a solids level suitable for shipping in commerce.

As was mentioned above, maximum advantages of the present invention are attained by operating at the highest practical solids level. If the viscosity of the slurry is reduced too much (i.e. to the point that the slurry will settle under static conditions), the impurities may be removed from the slurry by centrifugal force, but an undesirable amount of kaolinitic particles will also be removed, thus leading to a relatively low recovery.

In order to prepare the clay for the centrifugal treatment, it is necessary to disperse the clay in water, to form a slurry at a solids level above that at which a clay settles under static conditions. The dispersion must be made up with sufficient dispersing agent to give approximately the minimum viscosity. As is known to those skilled in the art, the amount of dispersing agent used to achieve the minimum viscosity will vary somewhat from one clay to another, but the conventional procedures for determining the minimum viscosity are well known. In carrying out the present invention it is preferred to use at least the amount dispersing agent to achieve the minimum viscosity or up to about 20% excess dispersing agent. Since the phosphate type dispersing agents tend to degrade in a slurry on standing, a small amount of excess (over the amount necessary to give the minimum viscosity) serves to make up for any degradation which might occur. Those skilled in the art are aware that if a substantial excess dispersing agent is added the viscosity increases, and for purposes of the present invention, may become unmanageable. As is indicated above, it is desired to operate the present invention close to the minimum viscosity, with respect to dispersing agent level.

As was mentioned above, clay slurries with viscosities below about 2000 cps, as measured by a low shear (10 rpm) Brookfield viscometer, may be advantageously run using the processes of the present invention. The present invention contemplates the processing of clay slurries having viscosities greater than 2000 cps, but such clays are more effectively processed with centrifugal apparatus capable of generating progressively greater gravitational forces. Many clays are pseudoplastic (exhibit shear thinning) and, therefore, agitation before and even during the centrifugation, tends to reduce the viscosity and, correspondingly, tends to improve the removal of impurities.

The examples set forth below are largely run on laboratory equipment. It is believed that the results described below can be translated into conventional plant equipment. Continuous centrifuges commonly have a turbulence factor which is not encountered in laboratory bottle centrifuges, and the moderate turbulence generated by continuous centrifuges may enhance the removal of some impurities because of the pseudoplastic nature of the clay being treated, and for this reason, continuous centrifuges are preferred. Further, heating the slurry and reducing the solids level somewhat will also decrease the viscosity and tend to improve the removal of impurities.

Preferably, the slurries processed in practicing the present invention are subjected to fairly intense centrifugation for relatively short periods of time. The laboratory data has shown that under constant total force (gravity multiplied by time), the low g centrifuge for longer periods of time remove much less impurities and coarse material than higher intensity conditions for a shorter duration. For this reason the high intensity short duration centrifugation is preferred.

It is generally felt that equipment capable of producing at least 100 g (100 times the force of gravity) is essential, and it is preferred to use machinery capable of applying at least 200 g to the clay slurries. Centrifuges capable of generating 500 to 1000 g or more may be advantageously used in treating high viscosity clay slurries in the practice of the present invention.

The following examples will serve to illustrate the preparation of several high solids clay slurries using centrifuges, but it is understood that the examples are set forth merely for illustrative purposes and many other techniques may be used which fall within the scope of the present invention.

EXAMPLE 1

A first sample production clay from East Georgia, was dispersed using approximately 7 pounds per ton of tetrasodium pyrophosphate, 1 pound per ton calgon, and 1 pound per ton soda ash to give a Brookfield viscosity at 10 rpm of 730 cp at 70% solids. The clay was dispersed at the solids level shown and then treated in a laboratory centrifuge at the speeds shown for 5 minutes. The centrifuge generated about 100 g at 750 rpm and about 180 g at 1000 rpm. The resulting brightness, solids and impurities are given in Table 1.

TABLE 1

Lab Centrifuged (5 min. throughout)

| | Brightness As Rec. | Brightness −325 mesh Screened | % Solids Start | % Solids Finish | % Rec. | % Screen Residue +200 m | % Screen Residue +325 m | $TiO_2$ | % $Fe_2O_3$ |
|---|---|---|---|---|---|---|---|---|---|
| Control | 82.0 | | 69.8 | | | .003* | .078* | 2.37 | 0.981 |
| 750 rpm - 70% Solids | 83.2 | 83.8 | 69.8 | 69.7 | 86.2 | .0024 | .086 | 2.37 | .972 |
| 1000 rpm - 70% Solids | 83.8 | 83.9 | 69.8 | 69.7 | 87.1 | .0011 | .016 | 2.34 | .965 |
| 750 rpm - 65% Solids | 84.0 | 84.0 | 65.0 | 64.2 | 88.2 | .00018 | .00038 | 2.27 | .938 |
| 1000 rpm - 65% Solids | 84.2 | 84.3 | 65.0 | 64.0 | 85.8 | 0.0 | 0.0 | 2.21 | .952 |
| 750 rpm - 60% Solids | 84.5 | 84.4 | 60.0 | 58.5 | 86.6 | 0.0 | .0022 | 2.19 | .954 |
| 1000 rpm - 60% Solids | 84.8 | 84.7 | 60.0 | 58.0 | 83.4 | .00016 | .00016 | 2.13 | .951 |

*The screen residue for the control was determined after severe blunging, which usually gives much lower value.

EXAMPLE 2

A second sample of East Gerogia clay was dispersed in water at the solids level shown in Table 2 using 7 pounds per ton of tetrasodium pyrophosphate, 1 pound per ton of calgon and 1 pound per ton of soda ash to give a pH of 7. The slurry at 70% solids showed a Brookfield viscosity of 440 cps at 20 rpm. The samples were treated in a laboratory centrifuge for 5 minutes at the speeds shown. The residues are shown in Table 2.

Table 2 shows a significant reduction in the amount of grit, a significant increase in brightness and a significant reduction in both titanium and iron impurities.

TABLE 2

Lab Centrifuge Tests 5 min. East Georgia Clay

| Sample | Br. As Rec. | % Solids Start | % Solids Finish | % Rec. | % Screen Residue +200 m | % Screen Residue +325 m | % $TiO_2$ | % $Fe_2O_3$ |
|---|---|---|---|---|---|---|---|---|
| Control | 82.8 | | | | 3.22 | 4.68 | 2.45 | .970 |
| 1000 rpm | 83.4 | 67.8 | 66.7 | 83.6 | .00086 | .0038 | 2.37 | .954 |
| 1000 rpm | 83.8 | 65.0 | 63.2 | 79.8 | .0008 | .0013 | 2.27 | .959 |
| 1000 rpm | 84.1 | 60.0 | N.D. | 76.3 | .0012 | .0015 | 2.13 | .901 |
| 750 rpm | 83.3 | 67.8 | 66.9 | 84.6 | .0021 | .061 | 2.39 | .947 |
| 750 rpm | 83.6 | 65.0 | 63.6 | 82.6 | .00078 | .0017 | 2.32 | .936 |
| 750 rpm | 83.9 | 60.0 | Not Determined | 77.7 | .0018 | .0019 | 2.22 | .929 |

EXAMPLE 3

Two selected East Georgia clays (identified as A and B) were dispersed, individually and in blends, as shown in Table 3, using the dispersant and dispersant levels shown. Both clays and the blends thereof had a minimum viscosity using from 6 to 8 pounds per ton of either trisodium pyrophosphate or calgon and enough soda ash to give a pH of about 7.0. Each sample was initially dispersed at 70.7% solids and treated for 5 minutes at 1000 rpm in a laboratory centrifuge. The results of the centrifuging are shown below in Table 3.

TABLE 3

East Ga. Clays Processed in a Laboratory Centrifuge - 5 min. at 1000 RPM*

| Sample | Dispersant No./T | No./T Soda Ash | % Solids | % Screen Residue +200 m | % Screen Residue +325 m | % Rec. | Screened Br. | % $TiO_2$ | % $Fe_2O_3$ | % $ZrO_2$ |
|---|---|---|---|---|---|---|---|---|---|---|
| Feed A | Calgon | | | | 2.542 | | 81.4 | 3.00 | .871 | .0399 |
| A | Calgon 5.5 | 3 | 70.5 | .0523 | .2439 | 93.8 | 82.1 | 2.90 | .852 | .0270 |
| A | Calgon 6.5 | 3 | 70.6 | .0262 | .1703 | 93.8 | 82.2 | 2.93 | .859 | .0258 |
| A | Calgon 7.5 | 3 | 70.6 | .0199 | .1425 | 93.9 | 82.3 | 2.95 | .858 | .0270 |
| A | Calgon 8.5 | 3 | 70.5 | .0299 | .1739 | 94.1 | 82.9 | 2.94 | .850 | .0266 |
| A-B Blend | Calgon 5.5 | 3 | 70.1 | .0039 | .0208 | 90.6 | 83.0 | 2.59 | .951 | .0220 |
| A-B Blend | Calgon 6.5 | 3 | 70.1 | .0024 | .0111 | 92.0 | 83.1 | 2.65 | .945 | .0216 |
| A-B Blend | Calgon 7.5 | 3 | 70.1 | .0026 | .0138 | 91.8 | 83.1 | 2.61 | .941 | .0223 |
| A-B Blend | Calgon 8.5 | 3 | 70.2 | .0029 | .0217 | 92.4 | 83.2 | 2.60 | .939 | .0205 |
| Feed B | Calgon | | | | 4.139 | | 83.2 | 2.23 | 1.05 | .0369 |
| B | Calgon 5.5 | 3 | 69.7 | .0012 | .0022 | 89.1 | 83.6 | 2.26 | 1.05 | .0175 |
| B | Calgon 6.5 | 3 | 69.7 | .0037 | .0054 | 89.1 | 83.5 | 2.25 | 1.05 | .0171 |
| B | Calgon 7.5 | 3 | 69.8 | .0016 | .0023 | 89.0 | 83.6 | 2.26 | 1.04 | .0172 |
| B | Calgon 8.5 | 3 | 69.8 | .0038 | .0048 | 88.9 | 83.9 | 2.26 | 1.05 | .0176 |
| Feed A | TSPP | | | | 2.356 | | 81.4 | 3.00 | .871 | .0399 |
| A | TSPP 5.5 | 1.27 | 70.5 | .2493 | .5704 | 89.8 | 82.8 | 2.95 | .877 | .0286 |
| A | TSPP 6.5 | 1.07 | 70.4 | .0996 | .3470 | 89.8 | 82.9 | 2.92 | .862 | .0281 |
| A | TSPP 7.5 | .87 | 70.4 | .0468 | .2354 | 93.1 | 83.2 | 2.91 | .866 | .0253 |
| A | TSPP 8.5 | .67 | 70.5 | .0280 | .1828 | 91.8 | 83.0 | 2.95 | .853 | .0255 |
| A-B Blend | TSPP 5.5 | 1.27 | 70.2 | .0211 | .1377 | 92.0 | 83.0 | 2.61 | .957 | .0245 |
| A-B Blend | TSPP 6.5 | 1.07 | 70.3 | .0026 | .0318 | 92.6 | 83.5 | 2.58 | .950 | .0295 |
| A-B Blend | TSPP 7.5 | .87 | 70.2 | .0012 | .0128 | 96.2 | 83.7 | 2.54 | .949 | .0218 |
| A-B Blend | TSPP 8.5 | .67 | 70.2 | .0017 | .0132 | 91.6 | 83.0 | 2.57 | .938 | .0211 |
| Feed B | TSPP | | | | 4.383 | | 83.2 | 2.23 | 1.05 | .0369 |
| B | TSPP 5.5 | 1.27 | 70.0 | .00087 | .0052 | 90.3 | 83.7 | 2.20 | 1.05 | .0168 |
| B | TSPP 6.5 | 1.07 | 70.0 | .00092 | .0017 | 90.8 | 84.0 | 2.17 | .984 | .0168 |
| B | TSPP 7.5 | .87 | 69.8 | .0012 | .0021 | 90.8 | 84.0 | 2.17 | 1.02 | .0170 |

TABLE 3-continued

East Ga. Clays Processed in a Laboratory Centrifuge - 5 min. at 1000 RPM*

| Sample | Dispersant No./T | No./T Soda Ash | % Solids | % Screen Residue +200 m | +325 m | % Rec. | Screened Br. | % $TiO_2$ | % $Fe_2O_3$ | % $ZrO_2$ |
|---|---|---|---|---|---|---|---|---|---|---|
| B | TSPP 8.5 | .67 | 70.0 | .000 | .00030 | 89.9 | 84.2 | 2.18 | 1.04 | .0170 |

*Initial solids 70.7% throughout.

EXAMPLE 4

A fourth sample of an East Georgia clay was dispersed in water at 67.8% solids using 7 pounds per ton of tetrasodium pyrophosphate, 1 pound per ton of calgon and 1 pound per ton of soda ash to give a pH of about 7.0. The resulting slurry, when measured at 69.7% solids showed a viscosity of 755 cps. at 20 RPM on the Brookfield viscometer. The slurry was fed through a continuous centrifuge running at 1200 RPM which generates about 800 g. The centrifuged clay had improved brightness and reduced titanium dioxide and ferrous oxide as is shown below in Table 4.

TABLE 4

Continuous Centrifuge of East Georgia Clay

| | Br. | Particle Size %+10μ | %−2μ | % Screen Residue +200 m | +325 m | % $TiO_2$ | % $Fe_2O_3$ |
|---|---|---|---|---|---|---|---|
| Feed | 82.9 | 4.0 | 91.8 | .0066 | .2942 | 2.71 | .927 |
| Effluent | 83.4 | 0.0 | 96.5 | .00034 | .00076 | 2.57 | .917 |

EXAMPLE 5

A fifth sample of East Georgia clay was made up in a slurry at 69.0% solids using 7 pounds per ton tetrasodium pyrophosphate, 1 pound per ton calgon, and 1 pound per ton soda ash to give a viscosity of 360 centipoises as measured by the Brookfield viscometer at 20 rpm. at 69.9 solids. The slurry was fed to a continuous centrifuge running at 1200 rpm (about 800 g) at the feed rates shown. Another portion of the slurry was fed to another continuous centrifuge running at 900 rpm (about 450 g) at the feed rates shown. For centrifuge No. 1, which has an approximate capacity of 14.5 gallons, the feed rates gave the following residence times:

| Feed Rates | | Residence Times | |
|---|---|---|---|
| 1 | ton/hr. | 4.5 | minutes |
| 8 | " | 0.56 | " |
| 10 | " | 0.45 | " |
| 15 | " | 0.30 | " |
| 20 | " | 0.22 | " |

For centrifuge No. 5, which has an approximate capacity of 62 gallons, the feed rates gave the following residence times:

| Feed Rates | | Residence Times | |
|---|---|---|---|
| 1 | ton/hr | 19.2 | minutes |
| 8 | " | 2.4 | " |
| 10 | " | 1.9 | " |
| 15 | " | 1.3 | " |
| 20 | " | 0.96 | " |

TABLE 5

Continuous Centrifuge of East Ga. Crude

| | RPM*** | TPH | % Screen Residue +200 mesh | +325 mesh | Particle Size %+10μ | %−2μ |
|---|---|---|---|---|---|---|
| Feed to Centrifuge 5** | | | 2.792 | 3.899 | 4.0 | 88.0 |
| Centrifuge 5 Effluent First Run | 1100 | 8–12 | .0063 | .1605 | 0.0 | 91.8 |
| Centrifuge 5 Effluent 11:00 Spot Check | 1100 | 8–12 | .0081 | .1505 | 0.0 | 91.0 |
| Centrifuge 5 Effluent 1:00 Spot Check | 1100 | 6–8 | .0110 | .0211 | 0.0 | 92.5 |
| Feed to Centrifuge 1** | | | 2.48 | 3.82 | 6.0 | 86.0 |
| Centrifuge 1 Effluent | 900 | 8–12 | .0234 | .1999 | 0.1 | 93.5 |
| Centrifuge 1 Effluent Spot Check | 900 | 8–10 | .0467 | .1545 | 0.0 | 93.0 |
| Centrifuge 1 Underflow* | | | 22.5 | 27.5 | 52.0 | 42.0 |

*Recovery calculated from underflow vs feed vs product % grit = 86.7 to 89.1
**69.0% Solids
***1200 RPM 800 g and 900 RPM 450 g

EXAMPLE 6

A sixth sample of East Georgia crude was made up in a slurry at 71.4% solids using 7 pounds per ton of tetrasodium pyrophosphate, 1 pound per ton calgon, and 1 pound per ton soda ash. It had a viscosity estimated to be in the 600–800 cps range. This slurry was fed at 8 to 12 tons per hour into the No. 1 continuous centrifuge operating at 1050 rpm (about 612 g).

This material was run for an interval at 71.4% solids and the results are shown below in Table 6, but subsequently the slurry was reduced to 67.1% solids to test the degree of improved coarse residue removal. The viscosity was not measured but was estimated to have been reduced by about 50% or about 300–400 cps.

The data in Table 6 show that the lower solids, and lower viscosity slurry, when centrifuged showed a lower amount of residue and a lower amount of +10m material remaining in the product.

TABLE 6

Continuous Centrifuge at 1050 RPM*** & 8–12 TPH East Georgia Crude

| | % Screen Residue +200 mesh | +325 mesh | Particle Size %+10μ | %−2μ | Br. | % Solids |
|---|---|---|---|---|---|---|
| Feed | 1.10 | 2.36 | 4.9 | 88.0 | 82.5* | 71.4 |
| Composite Effluent | .0041 | .184 | 1.0 | 92.5 | 82.8 | 70.6 |
| 4:00 Effluent | .00084 | .094 | 1.0 | 91.9 | 83.4 | 70.6 |
| 4:10 Effluent | .00032 | .048 | 0.0 | 93.5 | 83.3 | 70.6 |
| Underflow** | 69.4 | 80.3 | 84.6 | 8.0 | | |
| Feed Solids reduced from 71.4 to 67.1 to test degree of improved residue removal | | | | | | |
| Feed | .999 | 2.27 | 3.0 | 90.4 | 82.5* | 67.1 |
| Composite Effluent | .0014 | .0091 | 0.0 | 92.2 | 83.3 | 66.1 |
| 11:30 Effluent | .0002 | .00076 | 0.0 | 94.3 | 82.6 | 66.4 |

*Brightness after severe blunging
**Percent recovery calculated from feed vs underflow vs product % residue = 97.1 to 98.4
***1050 RM 612 g

EXAMPLE 7

A seventh sample of East Georgia clay was dispersed using 7 pounds per ton of tetrasodium pyrophosphate, calgon, and soda ash, at 70% solids level and the resulting slurry showed Brookfield viscosities of 410 cps. at 10 RPM; 265 cps. at 20 RPM; and 135 cps. at 100 RPM, and a pH of 7.1. As is shown in the table below, the control was subjected to three different techniques to remove the coarse particles, including conventional screening, centrifuging in accordance with the present invention and sedimentation. The screening successfully removed the coarse residue, but produced no significant change in the levels of impurities. The first batch of clay which was centrifuged at 70% solids showed substantial removal of the residue, an increase in the brightness and removal of substantial quantities of zirconium oxide. At the higher speed, there was significant reduction in titanium dioxide and other impurities.

The samples which were settled at 60% solids showed the presence of significant quantities of coarse residue. At 60% solids, the sedimentation process showed inadequate removal of impurities. The more diluted slurries produced improved results, but the product resulting therefrom obviously would have a much lower solids content and would require significant dewatering to produce a 70% solids commercial product. The results of these test are shown below.

TABLE 7

Screen vs High & Low Solids Classification by Gravity & Centrifuge

| Sample | % Rec. | % Screen Residue +200 m | +325 m | Br. | $SiO_2$ | $Al_2O_3$ | $K_2O$ | $TiO_2$ | $Fe_2O_3$ | $ZrO_2$ |
|---|---|---|---|---|---|---|---|---|---|---|
| Control No. 1 | 100 | 2.661 | 3.117 | 84.8 | 45.11 | 38.39 | .267 | 1.93 | 1.04 | .029 |
| Control No. 1 (Screened)−325 m | 96.9 | 0.00 | 0.00 | 84.9 | 44.96 | 38.58 | .248 | 1.93 | 1.03 | .027 |
| Control No. 2 | 100 | 2.632 | 3.056 | 84.8 | 45.82 | 38.86 | .275 | 1.92 | 1.05 | .025 |
| −100 mesh 2 (Screened) | 98.1 | .694 | 1.118 | 85.1 | 45.60 | 38.86 | .282 | 1.95 | 1.05 | .031 |
| −200 mesh 2 (Screened) | 97.4 | 0.00 | .424 | 85.5 | 45.57 | 38.89 | .271 | 1.93 | 1.04 | .029 |
| −325 mesh 2 (Screened) | 96.9 | 0.00 | 0.00 | 85.5 | 45.52 | 38.74 | .260 | 1.93 | 1.04 | .025 |
| Control No. 1 CENTRIFUGED | | | | | | | | | | |
| *70–10 min. 500 rpm (45 g) | 89.2 | .0298 | .0315 | 85.3 | 45.49 | 38.05 | .259 | 1.92 | 1.04 | .015 |
| *70–15 min. 1000 rpm (180 g) | 86.0 | .0017 | .0031 | 85.8 | 45.01 | 38.21 | .222 | 1.77 | 1.02 | .011 |
| *70–10 min. 1500 rpm (400 g) | 80.8 | .00135 | .0043 | 85.9 | 45.58 | 38.46 | .207 | 1.74 | 1.01 | .010 |
| *60.7–5 min. 500 rpm (45 g) | 90.6 | .0019 | .0034 | 86.0 | 45.15 | 38.78 | .220 | 1.83 | 1.03 | .011 |
| *60.7–5 min. 1000 rpm (180 g) | 85.3 | .00285 | .0056 | 86.2 | 45.25 | 38.57 | .193 | 1.74 | 1.04 | .010 |
| *60.7–5 min. 1500 rpm (400 g) | 79.7 | .0019 | .00365 | 87.0 | 44.88 | 38.89 | .183 | 1.64 | 1.03 | .009 |
| Control No. 1 SETTLED | | | | | | | | | | |
| *60.2–10 min./in. | 94.6 | .218 | .450 | 85.1 | 45.96 | 38.78 | .289 | 1.96 | 1.06 | .030 |
| *60.2–30 min./in. | 92.5 | .257 | .664 | 85.2 | 45.37 | 38.66 | .281 | 1.95 | 1.05 | .028 |
| *60.2–80 min./in. | 92.5 | .131 | .513 | 85.2 | 44.96 | 38.48 | .281 | 1.94 | 1.07 | .027 |
| *50.0–5 min./in. | 96.4 | .0120 | .101 | 85.4 | 45.39 | 38.53 | .263 | 2.08 | 1.01 | .021 |
| *50.0–15 min./in. | 94.7 | .00090 | .0085 | 85.3 | 45.62 | 38.41 | .258 | 1.90 | 1.01 | .017 |
| *50.0–40 min./in. | 89.3 | .00145 | .00325 | 85.6 | 45.27 | 37.77 | .249 | 1.87 | 1.02 | .014 |
| *40.0–5 min./in. | 94.2 | .00595 | .0209 | 85.3 | 45.09 | 38.58 | .255 | 1.94 | 1.04 | .018 |
| *40.0–15 min./in. | 92.1 | .00305 | .0059 | 85.3 | 44.49 | 38.19 | .241 | 1.89 | 1.00 | 0.16 |
| *40.0–60 min./in. | 90.2 | .0014 | .0031 | 85.8 | 44.58 | 38.61 | .226 | 1.83 | .998 | .020 |

*Starting percent solids
2 Control 2 was made from same clay sample, but was made up from a second dispersion of the same for screen tests 100, 200, and 325 mesh
1 Viscosity Brookfield: 410 at 10 rpm, 265 at 20 rpm, 135 at 100 rpm; 70% Solids; 7.1 pH

EXAMPLE 8

An eighth sample of East Georgia clay was dispersed at 71% solids and 65.15% solids using 7 pounds per ton of tetrasodium pyrophosphate, one ton per pound of calgon, and one ton per pound of soda ash. The viscosities of the two slurries were measured on the Brookfield viscometer and are as follows:

| | Brookfield, cp 10 rpm | 20 rpm | 100 rpm | °C Temp. |
|---|---|---|---|---|
| 71.5% Solids | 695 | 450 | 195 | 21.5 |
| 65.15% Solids | 175 | 114.5 | 86.8 | 25 |

These slurries were centrifuged, as shown below, in a laboratory centrifuge at the speeds shown. In addition to removing the coarse residue, particularly at speeds of more than 500 rpm, a significant variation in the impurities was noted. The results are as follows:

TABLE 8

Centrifuged 5 Minutes

| Sample | % Rec. | % Screen Residue +200 m | +325 m | Br. | % $TiO_2$ | % $Fe_2O_3$ | % $ZrO_2$ |
|---|---|---|---|---|---|---|---|
| Feed-70% Solids | 100.0 | 2.90 | 3.95 | 81.6 | 2.26 | 1.03 | .037 |
| 500 RPM 45 g | 89.5 | .348 | 2.48 | 81.6 | 2.26 | 1.02 | .025 |
| 1000 RPM 180 g | 84.5 | .00110 | .0301 | 82.3 | 2.18 | 1.02 | .016 |
| 2000 RPM 715 g | 76.7 | .00117 | .00304 | 82.5 | 2.01 | 1.01 | .014 |
| Feed-65% Solids | 100.0 | .81 | 1.61 | 80.9 | 2.80 | 1.00 | .038 |
| 500 RPM 45 g | 91.7 | .000763 | .0166 | 81.3 | 2.71 | .990 | .022 |
| 1000 RPM 180 g | 86.7 | .00108 | .00185 | 81.4 | 2.61 | .980 | .019 |
| 2000 RPM 715 g | 79.7 | .000962 | .00184 | 82.3 | 2.33 | .983 | .016 |

The foregoing products were screened and the +325 mesh residues were analyzed. The results are shown below compared the results of the products made by centrifuging four products made by screening. This data clearly shows that centrifuging gives much lower quartz contents.

| Sample | % +325 m | % Mica | % Kaolinite | % Quartz |
|---|---|---|---|---|
| CENTRIFUGED | | | | |
| 45g 500 RPM–70% Solids | 2.48 | 15.4 | 79.8 | 4.8 |
| 180g 1000 RPM–70% Solids | .0301 | 34.2 | 65.8 | Tr? |
| 715g 2000 RPM–70% Solids | .0304 | 28.9 | 71.9 | 0.0 |
| 45 g 500 RPM–65% Solids* | .0166 | 57.4 | 42.6 | Tr |

| | % +325 m | % Mica | % Kaolinite | % Quartz |
|---|---|---|---|---|
| SCREENED | | | | |
| 150 product | 2.24 | 32.3 | 15.8 | 51.8 |
| 200 product | 1.44 | 45.9 | 19.4 | 34.7 |
| 250 product | .971 | 48.3 | 28.1 | 23.6 |
| 325 product | .009 | 34.8 | 54.1 | 11.1 |

The process of the present invention may be carried out in many types of apparatus, so long as the apparatus is adapted to apply adequate gravitational (g) forces to a clay slurry. In addition to conventional centrifuges, hydroclones, any other devices which apply multiple gravitational forces may be used. While it is generally desired to apply more than 100 g to the clay slurry, and preferably more than 200 g, the upper limit of the g forces used in the process of the present invention is controlled chiefly by the machine design and the capability of the machine to apply multiple gravitational forces.

While the principal clay discussed in the foregoing application has been kaolin, it should be understood that the present invention may be applied to other clays such as Fuller's earth, Attapulgite, Ball clays and the like. The present invention may be used to remove silica, iron, titanium, zircon and other undesirable impurities from a wide variety of clays and clay-like materials.

The foregoing examples report viscosity measured on a Brookfield viscometer using a variety of different speeds or turbulence levels. In order to determine the minimum viscosity level, for any given clay slurry, it is desirable to employ a viscosity measuring instrument which generates a turbulence approximately the same as the turbulence found in the centrifuge. In order words, it is desired that the clay slurry, while it is subjected to the centrifugal forces, be at the lowest viscosity, with respect to dispersing agent levels. While the Brookfield viscometer run at 20 RPM approximates the turbulence levels of most present-day equipment, and has been generally accepted in the industry as a standard turbulence for measuring viscosity, it must be understood that for centrifuges other than those which are currently in commercial use, that other viscometer speeds would be more appropriate for determining the minimum viscosity.

The forms of invention herein shown and described are to be considered as only illustrative. Those skilled in the art will recognize that many changes may be made thereto without departure from the scope of the invention or the spirit of the appended claims.

We claim:

1. A method of removing coarse materials and chemical and mineral impurities from clay, which comprises forming a high solids slurry of a crude clay, water and a dispersing agent, said crude clay containing coarse material and chemical and mineral impurities, the quantity of water being sufficient to form a pumpable slurry which will not settle when subjected to static forces for 24 hours, the amount of said dispersing agent being sufficient to obtain the minimum viscosity for said slurry; subjecting said slurry to intense centrifugal forces for a short period of time; separating said coarse material and said chemical and mineral impurities; and recovering the suspended clay as a fine fraction having a reduced content of coarse material and reduced content of chemical and mineral impurities.

2. A method as described in claim 1 wherein the slurry is subjected to a centrifugal force of at least 100 g.

3. A method as described in claim 1 wherein said slurry is subjected to centrifugal forces of at least 200 g.

4. A method as described in claim 1 wherein the clay slurry contains at least 60% by weight solids.

5. A method as described in claim 1 wherein the clay slurry at least 70% by weight solids.

6. A method of producing a purified high solids suspension of kaolinitic clay which comprises mixing a crude clay with water and dispersing agent to form a high solids slurry, said clay containing coarse material, chemical and mineral impurities, the amount of dispersing agent being at least the minimum dosage necessary to form a minimum viscosity slurry, the amount of said water being sufficient to form a slurry which will not settle significantly under static conditions, said slurry having a viscosity below about 2000 centipoises as measured on the Brookfield viscometer at 10 RPM; centrifuging said slurry to separate coarse material and said chemical and mineral impurities; and recovering the dispersed portion of said clay as a high solids clay suspenison having a reduced content of coarse material and impurities.

7. A method as described in claim 6 wherein said clay slurry, which is centrifuged, comprises at least about 70% by weight solids.

8. A method as described in claim 6 wherein said clay slurry, which is centrifuged, comprises at least about 60% by weight solids.

9. A method as described in claim 6 wherein the centrifuging step subjects the clay to at least 100 g for 5 minutes.

10. A method as described in claim 6 wherein the centrifuging step subjects the clay to at least 200 g for 5 minutes.

11. A method of producing an improved high solids dispersion of kaolin which comprises dispersing crude kaolin at high solids in water with sufficient dispersing agent ot give the minimum viscosity, said dispersion having a solids level above that at which significant and adequate settling will occur under static conditions, and a viscosity below about 2000 centipoises as measured on the Brookfield viscometer at 10 RPM, centrifuging said crude clay dispersion, and recovering the suspended clay product as a purified product having a reduced content of coarse material and impurities.

12. A method as described in claim 11 wherein said centrifuged clay contains at least 70% by weight solids.

13. A method as described in claim 11 wherein said centrifuged clay contains at least 60% by weight solids.

14. A method as described in claim 11 wherein the centrifuging step subjects the clay to at least 100 g for 5 minutes.

15. A method as described in claim 11 wherein the centrifuging step subjects the clay to at least 200 g for 5 minutes.

* * * * *

UNITED STATES PATENT OFFICE
CERTIFICATE OF CORRECTION

Patent No. 4,018,673 Dated April 19, 1977

Inventor(s) Randall E. Hughes et al.

It is certified that error appears in the above-identified patent and that said Letters Patent are hereby corrected as shown below:

Column 2, line 48, change "contents" to --content--, and insert --%-- after "35"; column 3, line 65, substitute --an-- for "the", and insert --of-- after "amount"; column 4, line 61, delete the comma [,] after "Georgia"; column 4, line 65, change "cp" to --cps--; near bottom of columns 5 and 6, the column headings of "TABLE 3", change the second column heading "No./T" at the top of column 2 of "TABLE 3" (below "Dispersant") to --#/T--, since the symbol "#", in accordance with its common usage, represents pound or pounds, and move that column heading to the right so as to clearly show that it is the column heading for the third column of "TABLE 3", and, similarly, change the fourth column heading "No./T" (above "Soda Ash") of "TABLE 3" to --#/T--; continuation of "TABLE 3" at the top of column 7, change the second column heading "No./T" (below "Dispersant") to --#/T--, since the symbol "#", in accordance with its common usage, represents pound or pounds, and move that column heading to the right so as to clearly show that it is the column heading for the third column of the continuation of "TABLE 3", and change the fourth column heading "No./T" (above "Soda Ash") of the continuation of "TABLE 3" to --#/T--; column 7, last line of the paragraph below "EXAMPLE 4" and immediately above "TABLE 4", delete "is" before "shown below in TABLE 4"; column 7, last line of the paragraph below "EXAMPLE 5" (line 40), insert --%-- after "69.9"; columns 7 and 8, in the footnote designation "***" in the last line of "TABLE 5", insert --=-- after "RPM" (both instances); columns 9 and 10, the heading "Particle Size" of "TABLE 6", move that heading to the left sufficiently to clearly show that it is the heading for and applies to both

UNITED STATES PATENT OFFICE

CERTIFICATE OF CORRECTION

Patent No. 4,018,673 Dated April 19, 1977

Inventor(s) Randall E. Hughes et al.

It is certified that error appears in the above-identified patent and that said Letters Patent are hereby corrected as shown below:

of the subheadings "%+10μ" and "%-2μ"; column 9, the footnote "***" in the last line of "TABLE 6", change "RM" to --RPM=--; column 9, the first and third entries in column 1 (under the heading "Sample") of "TABLE 7", insert the footnote designations --1-- and --2-- after "Control No. 1" and "Control No. 2", respectively, so that those entries read --Control No. 1[1]-- and --Control No. 2[2]--, respectively; column 9, the footnote "1" in the last line of "TABLE 7", insert --cps-- after each of "410" and "265"; column 11, the unnumbered table following line 2, change the designation "cp" in the heading "Brookfield, cp" to --cps--; column 11, line 33, insert --and-- after "below" and --with-- after "compared", and substitute --obtained with-- for "of"; column 11, line 34, delete "four products made by screening"; column 11, line 36, change "contents" to --content--; column 11, unnumbered table following the paragraph ending in line 36, in the fourth entry "45g 500 RPM-65% Solids*" under the first column headings "Sample" and "CENTRIFUGED", delete the asterisk [*] following the word "Solids";

UNITED STATES PATENT OFFICE

CERTIFICATE OF CORRECTION

Patent No. 4,018,673 Dated April 19, 1977

Inventor(s) Randall E. Hughes et al.

It is certified that error appears in the above-identified patent and that said Letters Patent are hereby corrected as shown below:

column 11, line 63, after "hydroclones," insert --and--; column 12, line 14, delete the comma [,] after "level"; column 12, line 31, change "order" to --other--; column 12, line 34, delete the comma [,] before "with respect to"; column 12, line 40, delete "that"; column 13, line 4 (line 2 of claim 5), insert --contains-- after "slurry"; column 13, line 20 (line 15 of claim 6), change "suspenison" to --suspension--; and, column 14, line 10 (line 4 of claim 11), change "ot" to --to--.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*